US006011457A

United States Patent [19]

Sakamaki et al.

[11] Patent Number: 6,011,457

[45] Date of Patent: Jan. 4, 2000

[54] ENGINE IGNITING COIL DEVICE

[75] Inventors: Makoto Sakamaki; Toshiyuki Shinozawa; Yoshiharu Saito, all of Tsurugashima, Japan

[73] Assignee: Toyo Denso Kabushiki Kaisha, Tokyo, Japan

[21] Appl. No.: 08/919,722

[22] Filed: Aug. 28, 1997

[30] Foreign Application Priority Data

| | | | |
|---|---|---|---|
| Aug. 31, 1996 | [JP] | Japan | 8-266501 |
| Aug. 31, 1996 | [JP] | Japan | 8-266503 |
| Aug. 31, 1996 | [JP] | Japan | 8-266504 |

[51] Int. Cl.[7] ..... H01F 27/02; H01F 27/30

[52] U.S. Cl. ..... 336/96; 336/198; 336/92; 336/205; 123/634

[58] Field of Search ..... 336/205, 198, 336/107, 92, 96; 123/633, 634, 635, 647

[56] References Cited

FOREIGN PATENT DOCUMENTS 60-107813 6/1985 Japan .

*Primary Examiner*—Renee S. Luebke
*Assistant Examiner*—Anh Mai
*Attorney, Agent, or Firm*—Lyon & Lyon LLP

[57] ABSTRACT

An engine igniting coil device directly attachable to an igniting plug, wherein both primary and secondary coil bobbins have flangeless ends, the secondary coil bobbin has inwardly protruding ribs for coaxially supporting the flangeless end of the primary coil bobbin mounted therein and the secondary coil bobbin also has protrusions formed at its external wall apart from a high-voltage terminal of the secondary coil wound thereon and is coaxially mounted in a coil case by abutting its protrusions on an inner wall thereof, thus eliminating the possibility of damaging the bobbins by a large thermal stress produced in solidified insulating resin in a coil case by a differential thermal shrinkage in an axial direction and preventing a leakage current from a high-voltage side of the secondary coil bobbin to the coil case through a flange-like connection.

14 Claims, 4 Drawing Sheets

ENGINE IGNITING COIL DEVICE

BACKGROUND OF THE INVENTION

The present invention relates to an open-magnetic-circuit type engine-igniting coil device.

Japanese Laid-Open Patent No. 60-107813 discloses an open-magnetic-circuit-type engine igniting coil device which has a coil case which contains an assembly integrally molded therein by potting with melted insulating resin and consisting of a primary coil bobbin having a hollow center with a rod-shaped core and a secondary coil bobbin coaxially positioned on the primary coil bobbin and which is further provided at its lower portion with a high-voltage terminal connector to be directly connected with a tip of an ignition plug of the engine.

In the conventional engine igniting coil device, the primary coil bobbin can be coaxially mounted into a hollow shaft or center of the secondary bobbin by abutting at its flange against the inside wall of the hollow center of the secondary bobbin. The coil assembly can also be coaxially mounted in the coil case by abutting at its flange against the inner wall of the coil case.

In the conventional engine igniting coil device of the open-magnetic-circuit type, the rod-like core of the primary coil bobbin is provided at each end with a permanent magnet for obtaining a large change in magnetic flux with an interrupted primary current.

Japanese Utility Model Publication No. 4-23296 also discloses an open-magnetic-circuit-type engine igniting coil device which has a coil case containing a coil assembly integrally molded therein by potting with melted insulating resin and consisting of a primary coil bobbin having a hollow center with a rod-shaped core and a secondary coil bobbin coaxially fitted on the primary coil bobbin and which is further provided with an ignition-plug connector portion integrally formed on the coil case for direct connection with a ingition plug in such a way that a tip of the ignition plug inserted therein can contact with a high-voltage terminal inwardly projecting in the connector portion of the coil case.

In this engine igniting coil device, there is used a laminated core 9 that is, as shown in FIGS. 8 to 10, a lamination of sheet materials 91 fixed by caulking or staking (e.g., V-shape, circular or pin caulking) or welding by fusing heat. FIG. 8 illustrates a laminated core with a V-shape caulked portion 92 and FIG. 9 illustrates a laminated core with a round caulked portion 93. FIG. 10 shows a laminated core with a welded seam 94.

The above-mentioned prior arts devices, however, involve the following problems to be solved:

The first problem is that an engine igniting coil device directly attached to an ignition plug has a long case to be inserted into a cylindrical bore in a cylinder head of a vehicle engine and said case may therefore have a large amount of thermal elongation and shrinkage of metal, producing a large axial stress in the insulation resin layer formed therein and, in consequence of this, causing cracking of the flanges of the primary and secondary coil bobbins.

The arrangement of the flange of the secondary coil bobbin close to a portion with the high-voltage-side terminal of the secondary coil may cause a leak current to flow through the flange to the coil case.

The second problem is that the conventional open-magnetic-circuit type engine igniting coil device has two permanent magnets 10 attached to respective ends of the rod-shaped core 9 with a side step formed therebetween as shown in FIG. 5: each stepped portion may serve as a start point of cracking C1 in the insulating resin layer around thereof by transmitting a thermal stress, resulting in a breakage of the secondary coil bobbin 8.

In the open-magnetic-circuit type engine igniting coil device, the rod-shaped core inserted in the hollow center of the primary bobbin may suffer a relatively large thermal stress produced in its longitudinal direction, causing cracking of the insulating resin layer enclosing the core.

Furthermore, the device usually uses a secondary coil bobbin formed by using a through-type molding tool to minimize uneven thickness of its wall because it is impossible to form a long slender type secondary coil bobbin with a specified even wall thickness. However, the secondary coil bobbin 8 formed by using the through-type molding tool has a hole 111 formed therein by a center pin of the molding tool as shown in FIG. 5. This shortens a creeping discharge distance between a high-voltage terminal 12 and a core 9 to reduce the durability of the coil device. The secondary coil bobbin 8 may suffer cracking C2 due to a stress produced by a differential shrinkage of materials of the bobbin 8 and the core 9.

The third problem of the conventional open-magnetic-circuit type engine igniting coil device has the rod-like laminated core inserted in a hollow center of the coil assembly with primary and secondary coils, wherein a magnetic flux produced therein diverges outwardly and may suffer a loss of a flux part passing through a cylinder block of the engine, resulting in a decrease of the output factor of the secondary coil. It is needed to provide additional means for preventing the loss of magnetic flux.

In this case, the conventional laminated core has a portion partially deformed by caulking (e.g., V-shape, round or pin cauking) or welding, where a loss of magnetic flux may arise.

SUMMARY OF THE INVENTION

To solve the first problem, the present invention provides an engine igniting coil device directly attachable to an ignition plug of an engine, wherein a primary and secondary coil bobbins are flangeless (at least one end of each bobbin) and can be coaxially mounted with each other in a coil case, thus eliminating the possibility of damaging the coil bobbins due to a large axial stress produced by thermal expansion and contraction as well as the possibility of current leakage from the high-voltage portion of the secondary coil bobbin to the coil case.

In the ignition coil device of the present invention, the secondary coil bobbin has inwardly protruding ribs for coaxially supporting a flangeless end of the primary coil bobbin mounted therein.

In addition, the secondary coil bobbin has protrusions formed at its external wall apart from a high-voltage terminal of the secondary coil wound thereon.

To solve the second problem, the present invention provides an engine igniting coil device wherein a primary coil bobbin has a member integrally formed thereon for covering all sides of permanent magnets mounted on both ends of a rod-like core inserted in the primary coil bobbin, thus eliminating the possibility of forming cracks in insulating resin solidified around the coil assembly, starting from steps formed between the magnets and the core ends.

In the engine igniting coil device, the permanent magnets attached to both ends of the rod-like core are covered at their front surfaces with respective damper members made of elastic material, thus preventing the insulating resin around the core ends being cracked from a large stress produced from thermal expansion and contraction of the core in its longitudinal direction.

Furthermore, the secondary coil bobbin has a front extension for holding a high-voltage terminal and is designed so as to mount the primary coil bobbin with the core securing a specified distance from said extension to the damper member attached to the front end of the core, thus preventing a creep discharge from the high-voltage terminal to the core. This design can also prevent cracking of the secondary coil bobbin due-to the stress produced by the effect of a differential thermal deformation of the core and the secondary coil bobbin.

To solve the third problem, the present invention provides an open-magnetic-circuit type engine igniting coil device comprising a coil case and an assembly consisting of a secondary coil bobbin and a primary coil bobbin with a rod-like laminated core and integrally potted in the coil case with resin insulation, wherein the core is made of laminations of sheet materials bonded to each other with adhesive, thus eliminating the possibility of causing a loss of magnetic flux through connections such as staked, caulked or welded joint.

In the engine igniting device, the laminated core made of sheet materials bonded to each other is reliably secured to the coil bobbin by press-fitting it in the hollow center of the coil bobbin.

DESCRIPTION OF THE PREFERRED EMBODIMENTS

The preferred embodiments of the present invention will now be described in detail by way of example and with reference to the accompanying drawings.

Figure 1:
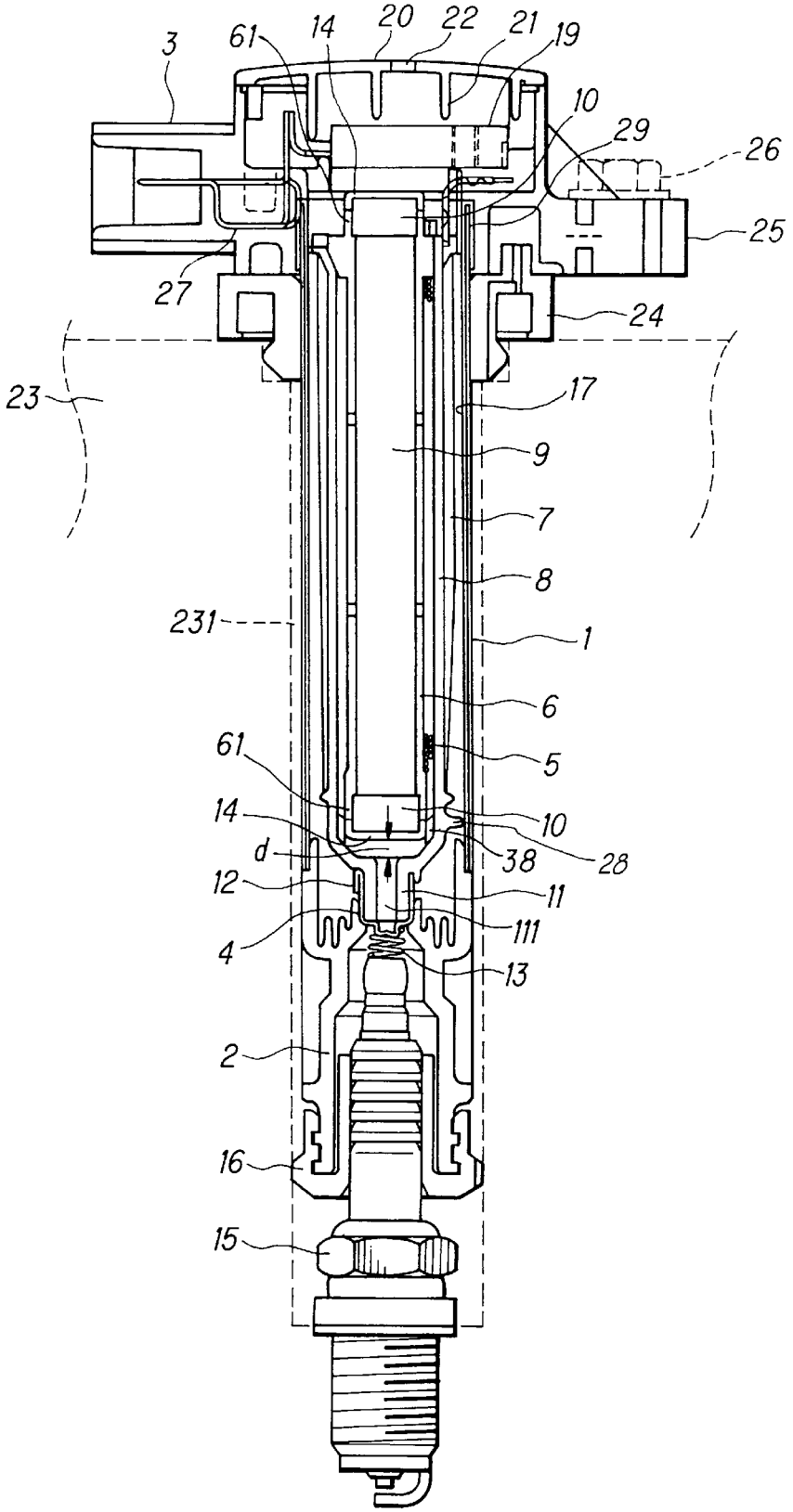
FIG. 1 is a sectional front view of an engine igniting coil device embodying the present invention.

As shown in FIG. 1, an engine igniting coil device according to the present invention has a coil case 1 for mounting therein a coil assembly, which has a plug cover 2 fitted in its lower open end and a low-voltage terminal socket 3 fitted on its upper open end.

The coil case 1 accommodates a coil assembly composed of a secondary coil bobbin 8 with a secondary coil 7, a primary coil bobbin 6 with a primary coil 5 inserted in a hollow center of the secondary coil bobbin and a rod-shaped core 9 inserted in a hollow center of the primary coil bobbin. The core 9 is provided at each end with a permanent magnet 10 for obtaining a large change in magnetic flux with an interrupted primary current.

A high-voltage terminal holder 11 is a center projection formed integrally with the lower end portion of the secondary coil bobbin 8. A high-voltage terminal 12 bonded to the holder 11 has a spring contact 13 attached thereto for providing electrical connection with an ignition plug 15.

The coil assembly composed of the primary coil bobbin 6, secondary coil bobbin 8, high-voltage terminal 12 and contact 13 is mounted in a given position and fixed in the coil case 1 in such a manner that a holder portion 11 of the high-voltage terminal 12 is press-fitted in a tubular hole 4 provided in a center portion of the plug cover 2 and the spring contact 13 project outwardly from the tubular hole 4.

The coil case 1 with the assembly fixed in the given position therein is filled with melted insulating resin (e.g., epoxy resin) injected through an upper open-end of the coil case 1 to form a single solid device with solidified resin insulation therein.

The permanent magnets 10 attached one to each end of the core 9 are covered with damping members 14, respectively, which can prevent intrusion of melted resin into the core 9 and absorb a relatively large thermal stress produced in the longitudinal direction of the core 9, thus preventing cracking of the resin layer formed around the core 9.

The plug cover 2 is provided at its bottom end with a plug rubber 16 for holding the ignition plug 15. When the ignition plug 15 is inserted into the plug rubber 16, a tip of the ignition plug 15 comes into contact with the spring contact 13, making an electrical connection with the ignition coil device.

Figure 2:
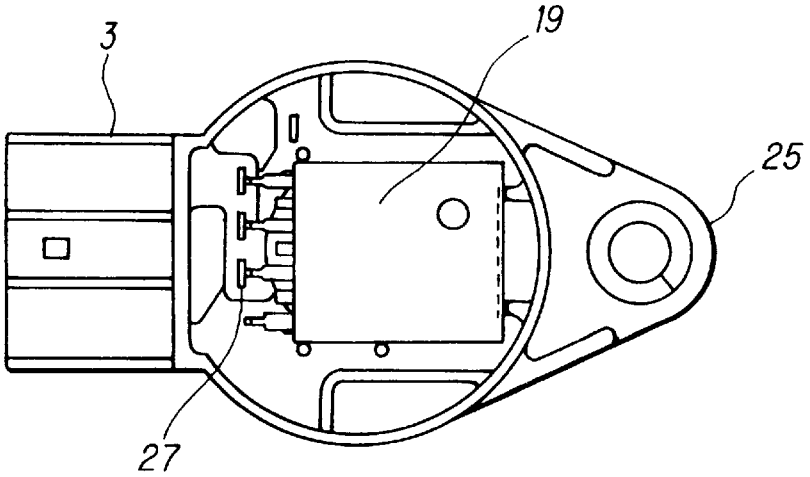
FIG. 2 is a plan view showing an internal structure of a low-voltage terminal socket portion of the engine igniting coil device shown in FIG. 1.

The low-voltage terminal socket 3 contains an igniter 19 as shown in FIG. 2.

The low-voltage terminal socket 3 is fitted on an outwardly bent or folded end-portion 29 of an elastic member 17 provided in the coil case 1 to assure a high sealing quality.

Melted resin is poured by using an injection nozzle into the low-voltage terminal socket 3 through a port 22 in the cap 20 mounted thereon until tips of ribs 21 formed on the inside wall of the cap 20 are immersed in liquid resin. Thus, the cap 20 is integrally fixed on the low-voltage-terminal socket. The ribs 21 of the cap 20 serve as a cushion for dispersing thermal stress to the resin layer, thus preventing cracking of the resin layer for the igniter 19.

The coil case 1 has a seal rubber 24 fitted on its external wall under the low-voltage terminal socket 3. This sealing rubber tightly seals the open end of the cylindrical bore 231 in the cylinder head 23 of the vehicle engine when the coil case 1 is inserted into the cylindrical bore 231 of the cylinder head 23.

With the coil case 1 mounted in the cylindrical bore 231, this ignition coil device is secured to the cylinder head 23 with a bolt 26 in a flange 25 integrally formed with low-voltage terminal socket 3.

The coil case 1 made of dielectomagnetic material having a high permeability (e.g., silicon steel) and is grounded through an electrical connection between the coil case 1 and a grounding terminal 27 in the low-voltage terminal socket 3.

Thus, the coil case 1 has an electromagnetic shielding effect and acts as a side core for concentrating a larger portion of magnetic flux produced by the open-magnetic-circuit type ignition coil assembly to the case 1, thus preventing the magnetic flux from passing through a cylinder block of the engine to cause a drop of the secondary output voltage.

Because the coil case 1 is maintained at the ground potential level, one is protected against an electrical shock by a discharge of leakage current from any internal high potential portion of the case 1.

Furthermore, the occurrence of a local corona discharge between the secondary coil 7 and the coil case 1 can be effectively prevented. This improves the durability of the insulating resin layer formed therebetween.

The tight connection of the coil case 1 with the cylinder head 23 of the vehicle engine eliminates the possibility of causing an electric discharge therebetween, thus improving the performance of the control system of the engine and peripheral devices.

Figure 3:
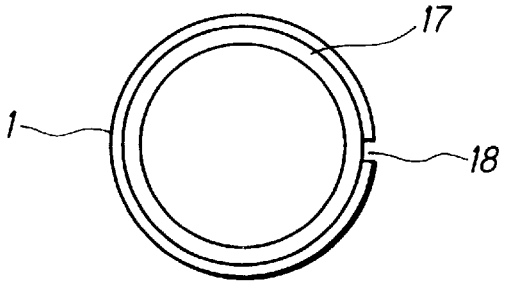
FIG. 3 is an end view of a coil case of the engine igniting coil device shown in FIG. 1.

As shown in FIG. 3, the coil case 1 has a slit 18 to form a gap of 0.5 to 1.5 mm in longitudinal direction and a C-shaped section to minimize an eddy current loss.

The coil case 1 is internally covered with an elastic member 17 such as rubber and elastomer. This elastic member 17 separates the resin layer from the inner wall of the coil case 1 and absorbs thermal stress of the metal, thus preventing the resin layer from cracking.

The engine igniting coil device thus constructed according to the present invention is further characterized by the following design features:

The primary coil bobbin 6 has at least one flangeless end and the secondary coil bobbin 8 has a rib 38 inwardly protruding from the inner wall thereof for supporting the flangeless end of the primary bobbin 6 inserted in the secondary bobbin 8.

The primary coil bobbin 6 can be coaxially mounted in the hollow center of the secondary coil bobbin 8 being supported at its flangeless lower end on the inside rib 38 of the secondary coil bobbin 8.

Figure 4:
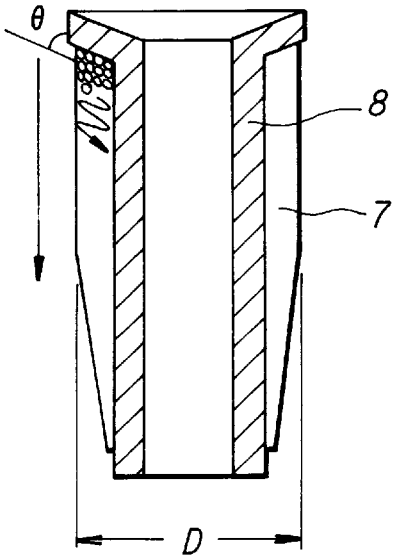
FIG. 4 is a sectional front view of a secondary coil bobbin on which a secondary coil is formed by bank winding with slope winding and which omits a flange at its one end.
Figure 5:
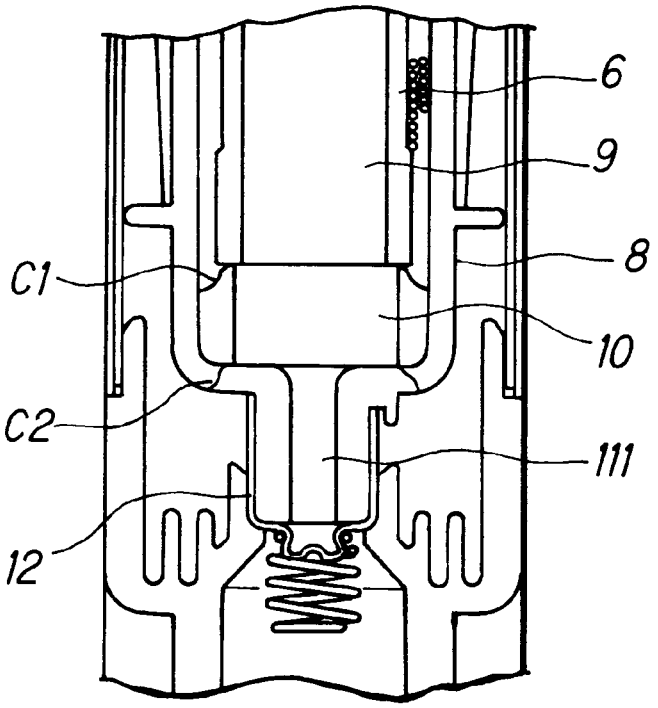
FIG. 5 is a sectional front view showing the general construction of an end portion of a coil assembly to be inserted into a coil case of the same type as the engine igniting coil device shown in FIG. 1.

As shown in FIG. 4, the secondary coil bobbin 8 also has a flangeless end. A secondary coil 7 is formed on the coil bobbin 8 by winding a wire axially in layers of turns (i.e., in banks) one by one at an angle θ (e.g., 25°) around the coil bobbin 8 and then reducing the number of turns in a layer one by one near one end to form a slope of coil (gradually reducing its diameter D) in the winding direction shown by an arrow in FIG. 4. The secondary coil bobbin 8 has a plurality of protrusions 28 formed thereon apart from the flangeless end. With the ignition coil assembly mounted in the coil case 1, these protrusions 28 of the secondary coil bobbin 8 can abut upon the inner wall of the coil case, thus centering the assembly therein.

These protrusions 28 are formed at the same distance on the same periphery of the secondary coil bobbin 8.

The use of the primary and secondary coil bobbins 6 and 8 each having at least one flangeless end eliminates the possibility of damaging the coil bobbins due to a large axial stress produced by thermal expansion and contraction of the resin insulation.

The primary coil bobbin 6 can be easily and reliably centered in the hollow center of the secondary bobbin 8 which in turn can be easily and reliably centered in the coil case 1.

The absence of a flange-like connection between the coil case and an end portion of secondary coil bobbin 8 near a high-voltage terminal of the secondary coil 7 eliminates the possibility of current leakage from the high-voltage portion of the secondary coil 7 to the coil case. This can effectively prevent reduction of the output voltage of the secondary coil as well as deterioration of the resin insulation thereabout.

The above-mentioned inventive design of coil bobbins is effective in particular for the ignition coil device that is mounted in a cylindrical bore 231 and directly connected to an igniting plug 15 of the engine since there is a limited capacity in the coil case 1 wherein the coil bobbins shall be accommodated with necessary insulation in particular for the high-voltage portion of the secondary coil.

To prevent only the leakage of current from the high-voltage portion, the secondary coil bobbin 8 may have a flange-like formed protrusion 28 if the later may not be broken due to the thermal deformation.

In the engine igniting coil device according to the present invention, the rod-like core 9 inserted in the hollow center of the primary bobbin 6 has cover members 61 integrally formed at both ends for covering the sides of the permanent magnets 10 when the later are attached to the respective ends thereof.

The cover members 61 can surely protect the resin insulation from cracking due to thermal stress concentrated at the steps formed between the permanent magnets 10 and the core 9.

The cover members 61 can also correctly locate the permanent magnets 10 when being attached to the respective ends of the rod-like core 9.

The exposed surface of each permanent magnet 10 attached to the end of rod-like core 9 is covered with a damper member 14 made of elastic material.

The damper member 14 is made of magnetic rubber, i.e., rubber containing magnetic powder and can, therefore, be easily attached to the permanent magnet 10 by magnetism without using adhesive or other mechanical means.

The damper members 14 can absorb relatively large thermal stress produced in the core 9 in the longitudinal direction, thus preventing cracking of the resin insulation thereabout.

The damper members 14 in combination with the cover members 61 of the core 9 enclose the permanent magnets 10, preventing the intrusion of insulating resin into the core end portions.

In the ignition coil device of the present invention, the secondary coil bobbin 8 has an inwardly protruding rib 38 for coaxially supporting the lower end of the primary coil bobbin 6 mounted therein, assuring a specified space d between the damper member 14 of the permanent magnet 10 and the high-voltage-terminal holding portion 11 of the secondary coil bobbin 8.

Since the primary coil bobbin 6 is thus coaxially mounted with the specified spacing at its tip in the secondary coil bobbin 8, an increased creepage distance can be obtained between a high-voltage terminal to be attached to the holding portion 11 of the secondary coil bobbin 8 and the core 9 through a through-hole 111 (formed by removing a center pin of a molding tool). This prevents creeping discharge through the creeping surface, assuring the improved quality of the insulation of the coil.

The specified distance d provided between the damper member 14 of the permanent magnet 10 attached to the lower end of the core 9 and the high-voltage terminal holder 11 of the secondary coil bobbin 8 can effectively prevent cracking of the secondary coil bobbin 8 due to a difference of thermal shrinkage between the core 9 and the secondary coil bobbin 8.

Figure 6:
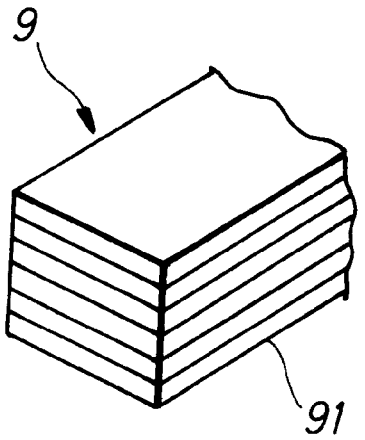
FIG. 6 is a partial perspective view of an example of a laminated core of an engine igniting coil device according to the present invention.

In the ignition coil device of the present invention, there is applied a core 9 made of laminations of sheet-like elements 91 glued to each other as shown in FIG. 6.

The glued laminated core 9 has no partially deformed (caulked or welded) portion that may cause a loss of magnetic flux by stress therein. This design feature is effective to improve the output factor of the open-magnetic-circuit type engine igniting coil device wherein a magnetic flux produced therein may diverge outwardly and may suffer loss of part of the flux passing through a cylinder block of the engine.

The adhesive used for laminating the sheet-like elements 91 into the core 9 does not dissolve an insulating film previously applied on each of the elements.

According to the present invention, the glued laminated core 9 is firmly secured by force fitting of it in the hollow center of the primary coil bobbin 6.

Figure 7:
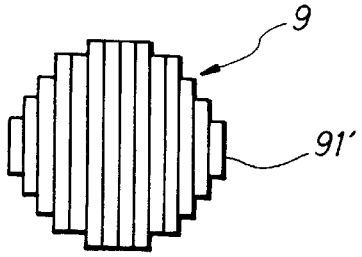
FIG. 7 is an end view of another example of a laminated core of an engine igniting coil device according to the present invention.
Figure 8:
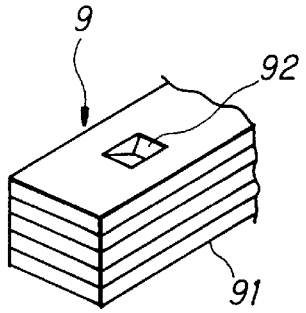
FIG. 8 PRIOR ART
FIG. 8 is a partial perspective view of an example of a laminated core of a conventional engine igniting coil device.
Figure 9:
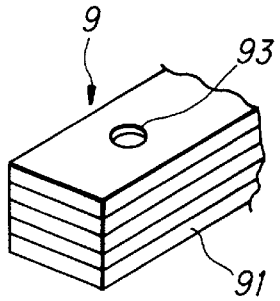
FIG. 9 PRIOR ART
FIG. 9 is a partial perspective view of another example of a laminated core of a conventional engine igniting coil device.
Figure 10:
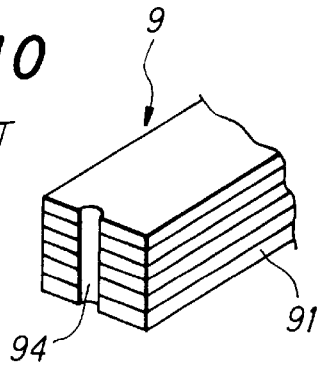
FIG. 10 PRIOR ART
FIG. 10 is a partial perspective view of a further example of a laminated core of a conventional engine igniting coil device.

A square type core 9 shown in FIG. 6 may be forcibly fitted in the hollow center of the primary coil 6. A further preferable core 9, shown in FIG. 7, has a nearly circular cross-section formed by laminating sheet-like elements 91' of different widths. The glue laminated core of circular cross-section can be more tightly fitted (with a higher space factor) in the hollow center of the cylindrical primary coil bobbin 6, thus assuring an improved factor of magnetic flux generation.

As described herein, one aspect of the present invention provides an engine igniting coil device directly attachable to an ignition plug of an engine, wherein a secondary coil bobbin can have coaxially mounted therein a primary coil bobbin by supporting a flangeless end of the primary coil bobbin by inwardly protruding ribs 38 of the secondary coil bobbin, thus eliminating the possibility of breakage in the primary coil bobbin due to a large axial stress produced by thermal differential contraction of the resin insulation and assuring easy and accurate centering of the primary bobbin in the secondary bobbin.

In another aspect of the engine igniting coil device of this invention directly attachable to an ignition plug, the secondary coil bobbin has protrusions 28 formed at its external wall at a sufficient distance from its flangeless end where a secondary coil terminates and can be coaxially mounted in a coil case by abutting the protrusions against the inside wall of the coil case, thus eliminating the possibility of damaging the secondary coil bobbin due to a large axial stress produced by thermal differential contraction of the resin insulation and preventing the occurrence of leaking current flowing from the high-voltage portion of the secondary coil bobbin to the coil case. This design feature also assures easy and correct centering of the secondary coil bobbin in the coil case.

In a further aspect of the open-magnetic-circuit type engine igniting coil device of this invention, the primary coil bobbin has cover members 61 integrally formed at both ends for enclosing sides of permanent magnets attached one to each end of a core inserted in the primary coil bobbin, thus preventing the surrounding insulation resin layer from cracking from stepped portions formed between the core ends and the bobbin ends. These cover members can correctly locate the permanent magnets on the respective core ends when attaching thereto the magnets by their magnetic force.

According to a still further aspect of the present invention, the permanent magnets are covered at their exposed end surfaces with damper members 14 made of elastic material, which can absorb a relatively large thermal stress produced in the longitudinal direction of the core, thus effectively preventing cracking of the insulating resin layers thereabout.

According to still another aspect of the present invention, the primary coil bobbin is coaxially mounted with the specified spacing at its tip in the secondary coil bobbin 8 having an extending portion for holding a high-voltage terminal. This design feature assures an increased creepage distance between a core and a high-voltage terminal attached to the holding portion of the secondary coil bobbin, thus preventing the insulation breakage by creeping discharge. This also prevents cracking of the secondary coil due to a difference of thermal shrinkage of the core and the secondary coil bobbin.

In another aspect of the open-magnetic-circuit type ignition coil device of the present invention, a core made of laminations of sheet-like elements glued to each other is used, which has no partially deformed (caulked or welded) portion and can therefore minimize a loss of magnetic flux by stress, attaining an increased output factor of the coil device.

We claim:

1. An engine igniting coil device mountable in a bore in a cylinder head of a vehicle engine and attachable directly to an ignition plug thereof, comprising a coil case provided at its open bottom with a plug cover and containing an internal coil assembly consisting of a secondary coil-wound bobbin, a primary coil-wound bobbin mounted in a hollow center of the secondary coil-wound bobbin and a rod-shaped core inserted in a hollow center of the primary coil-wound bobbin, said coil assembly being inserted in the coil case covered with the plug cover and integrally potted therein with resin insulation poured in a melted state and solidified in and around the internal coil assembly in the coil case, characterized in that the primary coil-wound bobbin has a flangeless end, and the secondary coil-wound bobbin is provided with a radially and inwardly protruding rib for coaxially mounting and supporting the primary coil-wound bobbin in the hollow center of the secondary coil-wound bobbin by abutting against the flangeless end of the primary coil-wound bobbin, and the secondary coil-wound bobbin has a flangeless end provided with a radially and outwardly protruding protrusion for coaxially mounting and supporting the secondary coil-wound bobbin in the coil case by abutting against an inside-wall of the coil case.

2. An engine igniting coil device as defined in claim 1, characterized in that the core has two permanent magnets attached one to each end thereof and the primary coil bobbin has members integrally formed thereon for covering sides of the permanent magnets.

3. An engine igniting coil device as defined in claim 2, characterized in that said two permanent magnets each are provided at its front with a damper member made of elastic material.

4. An engine igniting coil device as defined in claim 3, characterized in that the damper member is made of magnetic material.

5. An engine igniting coil device as defined in claim 1, characterized in that two permanent magnets are attached one to each end of the core and are provided each at its front with a damper member made of elastic material.

6. An engine igniting coil device as defined in claim 5, characterized in that the damper member is made of magnetic material.

7. An engine igniting coil device as defined in claim 1, 2, 5 or 6 characterized in that the secondary coil bobbin has a protrusion formed at its end for attaching a high-voltage terminal thereto and has means for positioning a bottom end of the primary coil bobbin inserted in the hollow center thereof to secure a specified gap between the protrusion for the high-voltage terminal and the core inserted in the hollow center of the primary bobbin.

8. An engine igniting coil device of the open-magnetic-circuit type, comprising a coil case provided at an open bottom with a plug cover and containing an internal coil assembly consisting of a secondary coil-wound bobbin, a primary coil-wound bobbin mounted in a hollow center of the secondary coil-wound bobbin and a rod-shaped core inserted in a hollow center of the primary coil-wound bobbin, said coil assembly being inserted in the coil case covered with the plug cover and integrally potted therein with resin insulation poured in a melted state and solidified in and around the internal coil assembly in the coil case, characterized in that the secondary coil bobbin has a protrusion formed at its end for attaching a high-voltage terminal thereto and has means for positioning a bottom end of the primary coil bobbin inserted in the hollow center thereof to secure a specified gap between the protrusion for the high-voltage terminal and a damper member attached to the core inserted in the hollow center of the primary bobbin.

9. An engine igniting coil device as defined in claim 8, characterized in that the damper member is made of magnetic elastic material.

10. An engine igniting coil device mountable in a bore in a cylinder head of a vehicle engine and attachable directly to to an ignition plug thereof, comprising a coil case provided at its open bottom with a plug cover and containing an internal coil assembly consisting of a secondary coil-wound bobbin, a primary coil-wound bobbin mounted in a hollow center of the secondary coil-wound bobbin and a rod-shaped core inserted in a hollow center of the primary coil-wound bobbin, said coil assembly being inserted in the coil case covered with the plug cover and integrally potted therein with resin insulation poured in a melted state and solidified in and around the internal coil assembly in the coil case, characterized in that the secondary coil-wound bobbin has a flangeless end provided with a radially and outwardly protruding means for coaxially mounting and supporting the secondary coil-wound bobbin in the coil case by abutting against an inside-wall of the coil case.

11. An engine igniting coil device as defined in claim 10, characterized in that the secondary coil bobbin has a plurality of protrusions formed at periphery thereof as said protruding means.

12. An engine igniting coil device as defined in claim 10, characterized in that the secondary coil bobbin has a collar-like protrusion as said protruding means.

13. An engine igniting coil device mountable in a bore in a cylinder head of a vehicle engine and attachable directly to an ignition plug thereof, comprising a coil case provided at its open bottom with a plug cover and containing an internal coil assembly consisting of a secondary coil-wound bobbin, a primary coil-wound bobbin mounted in a hollow center of the secondary coil-wound bobbin and a rod-shaped core inserted in a hollow center of the primary coil-wound bobbin, said coil assembly being inserted in the coil case covered with the plug cover and integrally potted therein with resin insulation poured in a melted state and solidified in and around the internal coil assembly in the coil case, characterized in that the primary coil-wound bobbin has a flangeless end, and the secondary coil-wound bobbin is provided with a radially and inwardly protruding rib for coaxially mounting and supporting the primary coil-wound bobbin in the hollow center of the secondary coil-wound bobbin by abutting against the flangeless end of the primary coil-wound bobbin.

14. An engine igniting coil device as defined in any one of claims 13, 10, 11, 12, 9 or 8 characterized in that the core is made of a plurality of sheet elements laminated by bonding and is press-fitted in the hollow center of the primary coil bobbin.

* * * * *